US008245362B2

(12) United States Patent
Blevins

(10) Patent No.: US 8,245,362 B2
(45) Date of Patent: Aug. 21, 2012

(54) GOLF CLUB HEAD COVER AND GLOVE TETHER KIT

(76) Inventor: Colin Blevins, Kokomo, IN (US)

( * ) Notice: Subject to any disclaimer, the term of this patent is extended or adjusted under 35 U.S.C. 154(b) by 520 days.

(21) Appl. No.: 12/584,860

(22) Filed: Sep. 14, 2009

(65) Prior Publication Data

US 2010/0064485 A1 Mar. 18, 2010

Related U.S. Application Data

(60) Provisional application No. 61/192,118, filed on Sep. 15, 2008.

(51) Int. Cl.
*A63B 55/00* (2006.01)

(52) U.S. Cl. ..... 24/298; 24/3.13; 24/301; 24/302; 24/306; 150/160

(58) Field of Classification Search ..... 24/3.1, 24/3.13, 4, 72.1, 298, 300–302, 306; 150/160
See application file for complete search history.

(56) References Cited

U.S. PATENT DOCUMENTS

| | | | | | |
|---|---|---|---|---|---|
| 1,957,577 | A | * | 5/1934 | Chapman | 150/160 |
| 3,015,351 | A | | 1/1962 | Harris | |
| 3,460,207 | A | * | 8/1969 | Stewart | 24/302 |
| 3,638,284 | A | * | 2/1972 | Baker | 24/306 |
| 4,126,166 | A | | 11/1978 | Hohenstein | |
| 4,296,787 | A | | 10/1981 | Barton | |
| 4,361,934 | A | * | 12/1982 | Darnell | 24/3.12 |
| 4,625,862 | A | | 12/1986 | Clayton | |
| 5,025,843 | A | | 6/1991 | Caufield | |
| 5,109,578 | A | * | 5/1992 | Cox | 24/298 |
| 5,246,108 | A | | 9/1993 | Nusbaum | |
| 5,722,125 | A | * | 3/1998 | Vasilopoulos | 24/301 |
| 5,746,265 | A | | 5/1998 | Hoyt et al. | |
| 6,076,668 | A | | 6/2000 | Keane et al. | |
| 6,116,307 | A | | 9/2000 | Mangigian | |
| 6,434,800 | B1 | | 8/2002 | James et al. | |

* cited by examiner

*Primary Examiner* — Robert J Sandy
(74) *Attorney, Agent, or Firm* — Frank D Lachenmaier

(57) ABSTRACT

An adjustable, elastic strap that can be fastened to a golf bag on one end and pinned to a golf club head cover or a hook and loop type pad on the other end utilized to eliminate lost head covers and golf gloves caused by misplacing or forgetting the covers or gloves after use.

2 Claims, 6 Drawing Sheets

GOLF CLUB HEAD COVER AND GLOVE TETHER KIT

BACKGROUND

1. Field of Invention

The present invention relates to a kit of tethers for golf accessory temporary attachment to a golf bag to prevent head covers from being lost when removed from golf clubs and providing a convenient storage and drying location for a golf glove while walking between shots, putting or longer term storage.

2. Prior Art

There have been several patents purporting to resolve the lost head cover problems and the damage to golf gloves when stored while wet. To date all of these have proven commercially impractical for reasons of complexity, cost, durability and difficulty in retrofitting existing golf bags and covers.

SUMMARY OF THE INVENTION

A simple system is used to connect both golf club and or golf gloves to conventional golf bags in such a manner as to:

a) easily attach to all the various types and styles of head covers from knitted to leather;
b) easily attach to all the various type and style of golf bags either by snapping on bag cover snap studs or by looping through a ring or closed end projection attached to a golf bag and snapping back on its own stud;
c) be adjustable in length for different length golf clubs;
d) be of elastic material such that can be easily stretched to allow removing and replacing head cover after club use and not have excess material to tangle if more than one cover is off at a time; and
e) attach to cover in such a manner as to not mar the surface of the golf club head or shaft being covered.
f) attach to golf gloves utilizing the hook and loop standard materials on the golf glove back closure.

DRAWINGS

In order that the invention is fully understood it will now be described with reference to the following drawings in which.

Figures 1A, 1B, 1C:
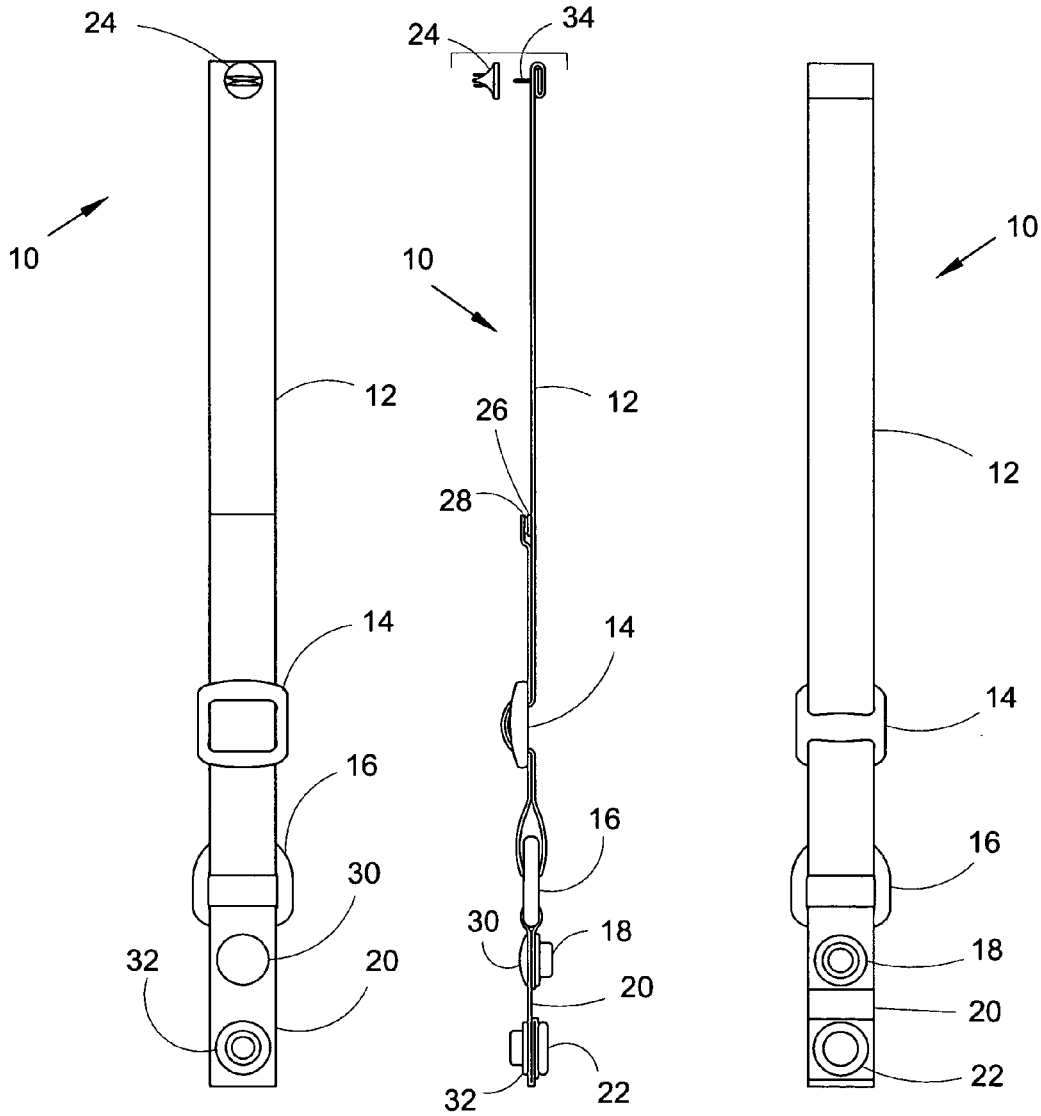
FIG. 1A is a front view of a head cover tether.
FIG. 1B is a side view of a head cover tether.
FIG. 1C is a rear view of a head cover tether.
Figures 2A, 2B, 2C:
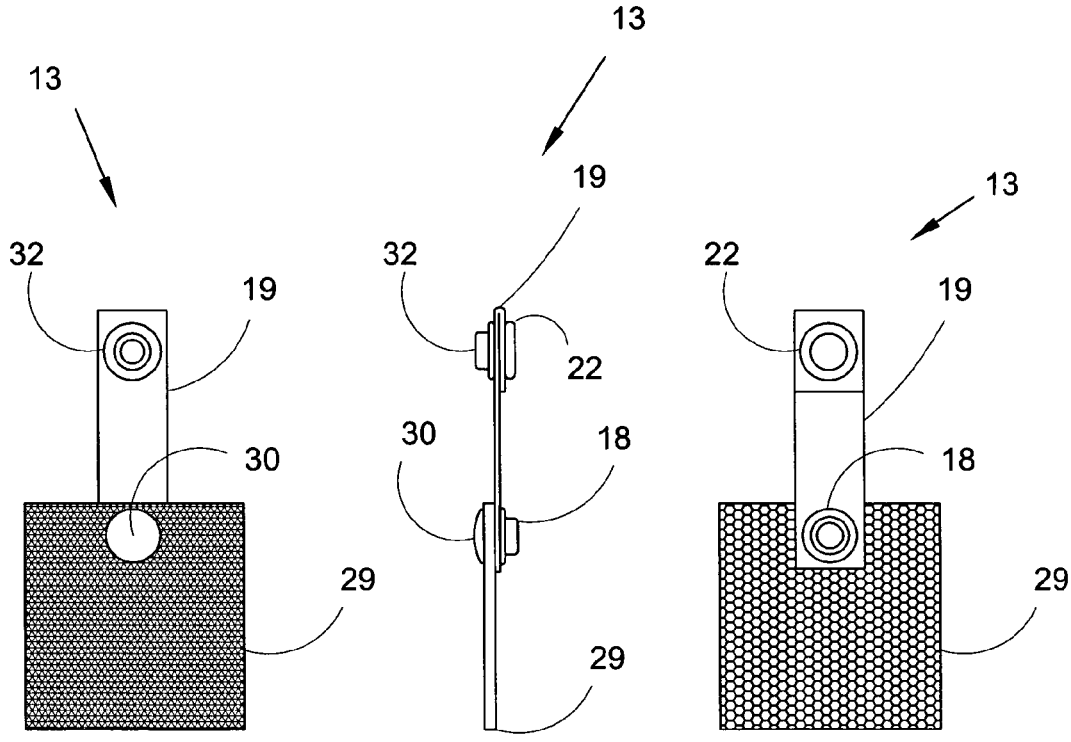
FIG. 2A is a front view of a golf glove tether.
FIG. 2B is a side view of a golf glove tether.
FIG. 2C is a rear view of a golf glove tether.

The golf bag, golf bag cover attachment stud, golf club, golf club head cover and golf glove are not part of this invention and are shown in phantom lines.

REFERENCE NUMBERS

The reference numbers for the same or similar parts will be used throughout the various views.

DESCRIPTION

In order that head cover tether 10, multi-head cover tether 11 and glove tether 13 are fully understood they will now be described by way of the following examples. This new invention is used to eliminate lost head covers 46 from golf clubs 44 and golf gloves 45 while clubs 44 are being used or gloves 45 are removed during walking between shots, putting, storage or drying. Tethers 10,11 and 13 provide a less complex, more durable and less expensive solution to these problems than those systems found and cited as prior art, with no modifications required to golf bag 40, covers 46 or gloves 45.

FIG. 1A shows a front view of head cover tether 10 with button pin protector 24 in place at its distal end. Button pin 34's pin is pushed through one layer of long strap 12 which is then folded over the head of button pin 34 thus protecting golf clubs 44 from being marred by contact with button pin 34's head as shown in FIG. 1B. Long strap 12 is again folded over button pin 34 and the pin pushed through this second layer of long strap 12 and held in place by button pin protector 24 until time to install Head Cover Tether 10 onto head cover 46 as shown in partial assembly on FIG. 1B and FIG. 7.

Long strap 12 is preferably constructed of an elastic material varying from approximately 15 inches long for a putter, to approximately 23 inches long for a driver×¾ inch wide and 0.040 inches thick. Head cover tethers 10 and 11 have sufficient stretch as to easily allow replacing head covers 46 onto golf clubs 44 after use. Long strap 12 is pushed up into first opening in 3 bar slide 14, over the center bar and down through the second opening, looping around the top of D-ring 16 and back up and through second opening in 3-bar slide 14 over the center bar and back out through the first opening with the proximal end of long strap 12 left extending past 3-bar slide at the proper length for the individual golf club 44 selected. The proximal end of long strap 12 has a hook and loop type spot 28 and the central section of long strap 12 has a hook and loop type anchor 26 stretch that when spot 28 is connected anchor strip 26 loose ends of long straps 12 are eliminated.

Short strap 20 is constructed of the same elastic material as long strap 12 and is approximately 4⅝ inches long. The distal end of Short strap 20 loops around the bottom of D-ring 16 as shown in FIGS. 1A, 1B and 1C and the loop is held together with cap 30 pressed into stud fastener 18. A gypsy stud 32 is a stud that is staked to the back side of a socket fastener. The proximal end of short strap 20 is folded back on itself twice and these folds held together by gypsy stud 32 pressed into back of socket fastener 22. The combination of long strap 12 and short strap 20 connected at D-ring 16 form adjustable length cover strap 48.

Figure 9A:
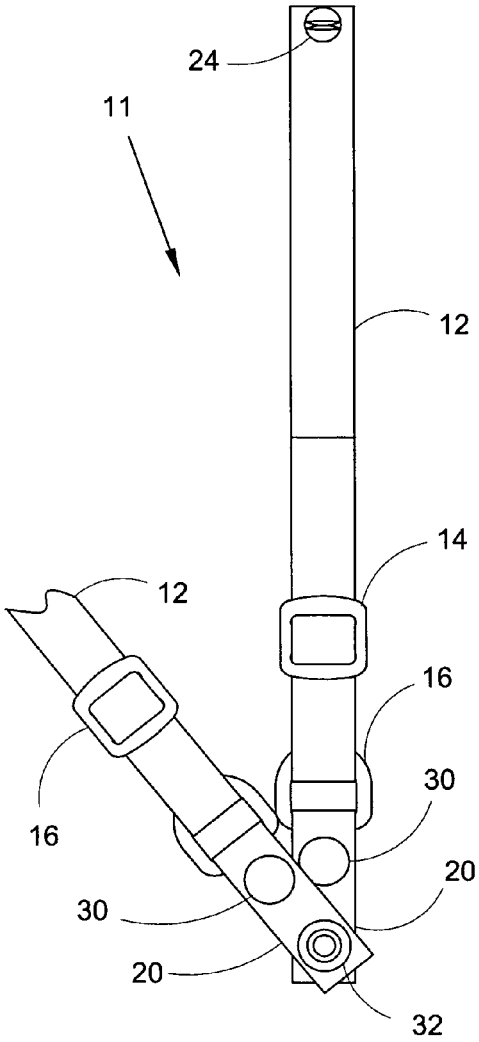
FIG. 9A is partial front view of a 2 head cover tether.
Figure 9B:
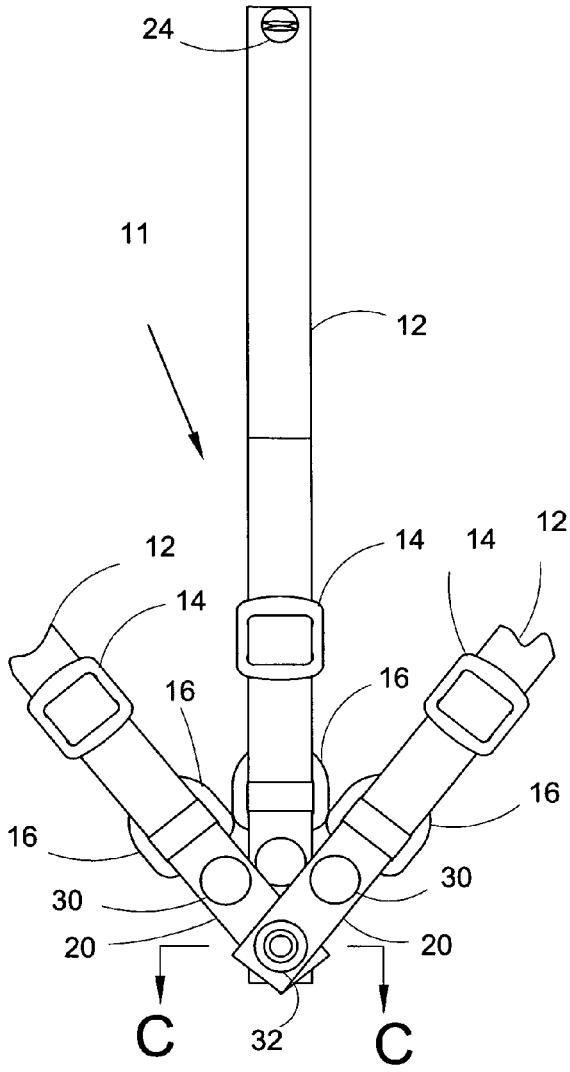
FIG. 9B is a partial front view of a 3 head cover tether.
Figure 9C:
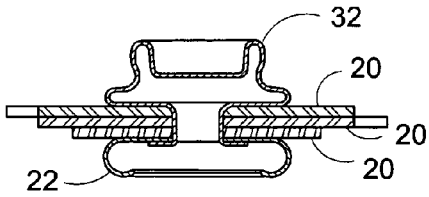
FIG. 9C is an enlarged section view taken along section arrows C-C showing 3 short straps secured between a gypsy stud and a socket fastener.

Two or three proximal ends of short straps 20 are held together without folding by gypsy stud 32 pressed through the stack of short strap 20 proximal ends into socket fastener 22 for Multi-head Cover Tethers 11 as shown in FIGS. 9 A, B and C.

Glove strap 19 is constructed of the same elastic material as long strap 12 and short strap 20. Glove strap 19 is folded over once at the top end and held together by gypsy stud 32 pressed into socket fastener 22 for golf glove tether 13 and the bottom of glove strap 19 is connected to a hook and loop type pad 29 by pressing cap 30 through pad 29 into stud fastener 18 where hook and loop pad 29 has a loop side to interface with the hook side of the inside of a golf glove back closure and a hook side to interface with the loop side of the outside back of the golf glove.

OPERATION

Figure 3:
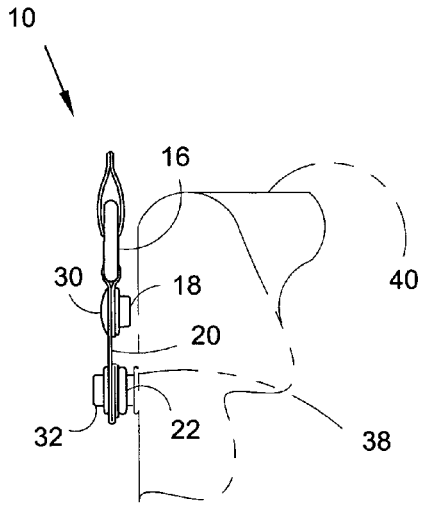
FIG. 3 is a partial side view showing a head cover tether snapped on to a standard golf bag cover attachment stud.

FIG. 3 shows head cover tether 10 with socket fastener 22 snapped onto golf bag cover attachment stud 38 which is one of several attachment studs 38 surrounding the upper outside of standard golf bags 40. These studs 38 are normally used to snap a cover over golf bag 40 to protect golf clubs 44 during travel or inclement weather. Since head cover tether 10 uses gypsy stud 32 on one side and socket fastener 22 on the other, head cover tether 10 does not have to be removed to snap the bag cover in place, the bag cover can be snapped directly onto gypsy stud 32 on head cover tether 10.

Figure 3A:
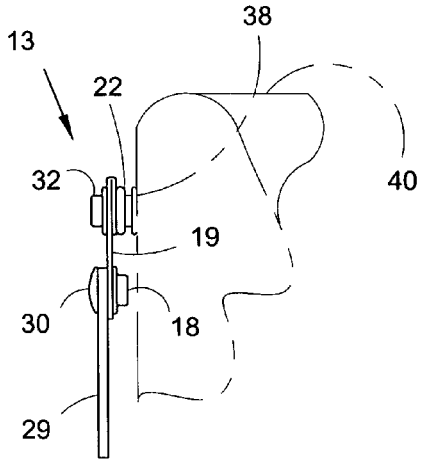
FIG. 3A is a partial side view showing a golf glove tether snapped to a standard golf bag cover attachment stud.

FIG. 3A shows golf glove tether 13 with socket fastener 22 snapped onto golf bag cover attachment stud 38 which is one of several surrounding the top end of standard golf bag 40.

Figure 4:
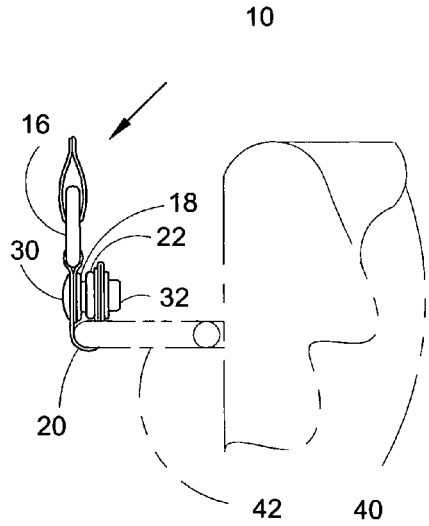
FIG. 4 is a partial side view showing a head cover tether with a strap wrapped around and through a loop attached to a golf bag and snapped back on its own stud fastener.

FIG. 4 shows head cover tether 10 with short strap 20 looped around golf bag ring 42 and socket fastener 22 snapped back onto its fastener stud 18. This attachment embodiment could be utilized by wrapping short strap 20 around any type of closed end projections from golf bag 40. Again the elastic material utilized for short strap 20 allows enough stretch to fit over numerous size projections to anchor the proximal end of head cover tether 10 or multi-head cover tether 11 to golf bag 40.

Figure 4A:
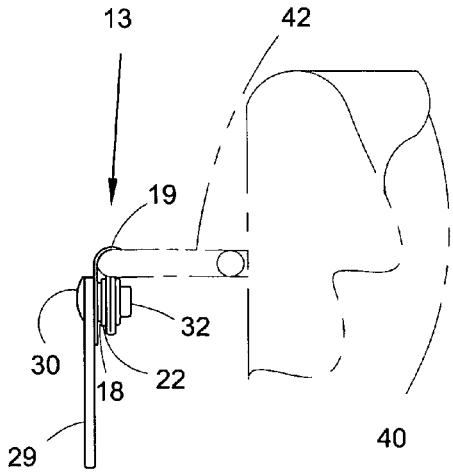
FIG. 4A is a partial side view showing a golf glove tether with a strap wrapped around and through a loop attached to a golf bag and snapped back on its own stud fastener.

FIG. 4A shows golf glove tether 13 with glove strap 19 looped around golf bag ring 42 and socket fastener 22 snapped back onto its fastener stud 18.

Figure 8:
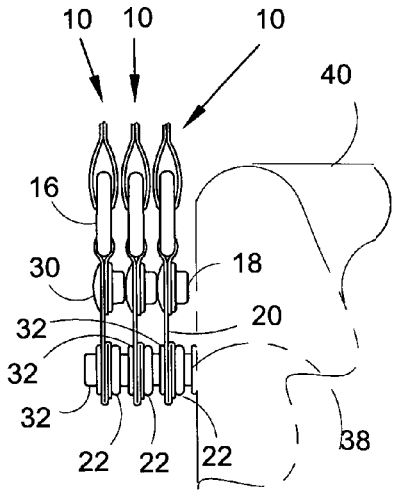
FIG. 8 is a partial side view showing three head cover tether's socket fasteners snapped on to a standard golf bag cover attachment stud.

FIG. 8 shows a third attachment embodiment where three head cover tethers 10 are attached to one golf bag cover mounting stud 38. In this embodiment the first head cover tether 10 is snapped onto golf bag stud 38 as in the first embodiment shown in FIG. 3. The second head cover tether 10's socket fastener 22 is then snapped on the first head cover tether 10's gypsy stud 32 and the third head cover tether 10's socket fastener 22 is snapped onto the second head cover tether 10's gypsy stud 32. This process, however, could reduce the flexibility of being able to snap a bag cover onto all of bag cover attachment studs 38.

Figure 5:
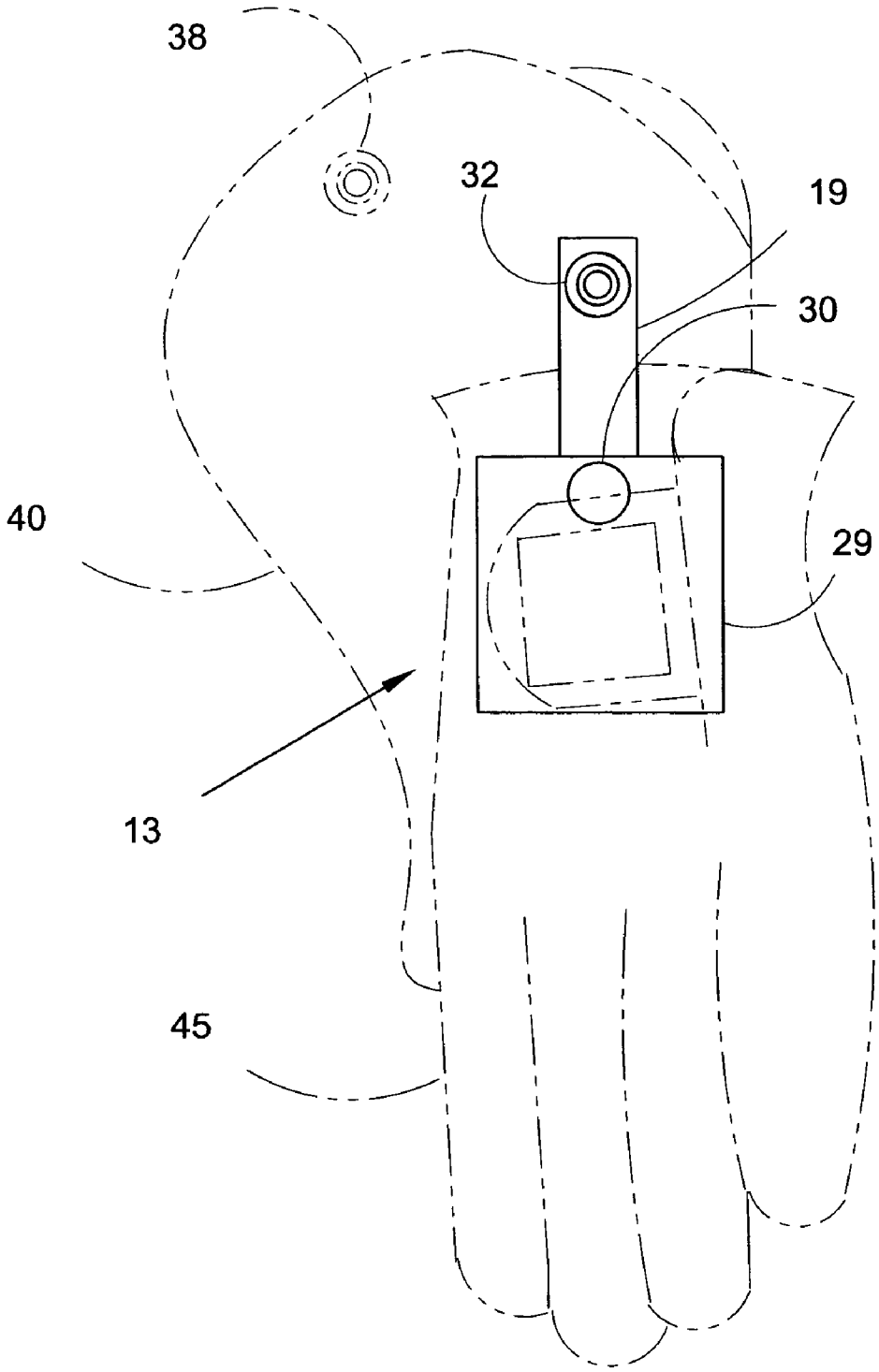
FIG. 5 is a partial side view showing a golf glove tether connected between a standard golf bag cover attachment stud on a standard golf bag and a golf glove.

FIG. 5 shows golf glove tether 13 with hook and loop pad 29 sandwiched between the hook pad on the inside of a golf glove back closure and the loop surface on the outside of the back of a golf glove.

Figure 6:
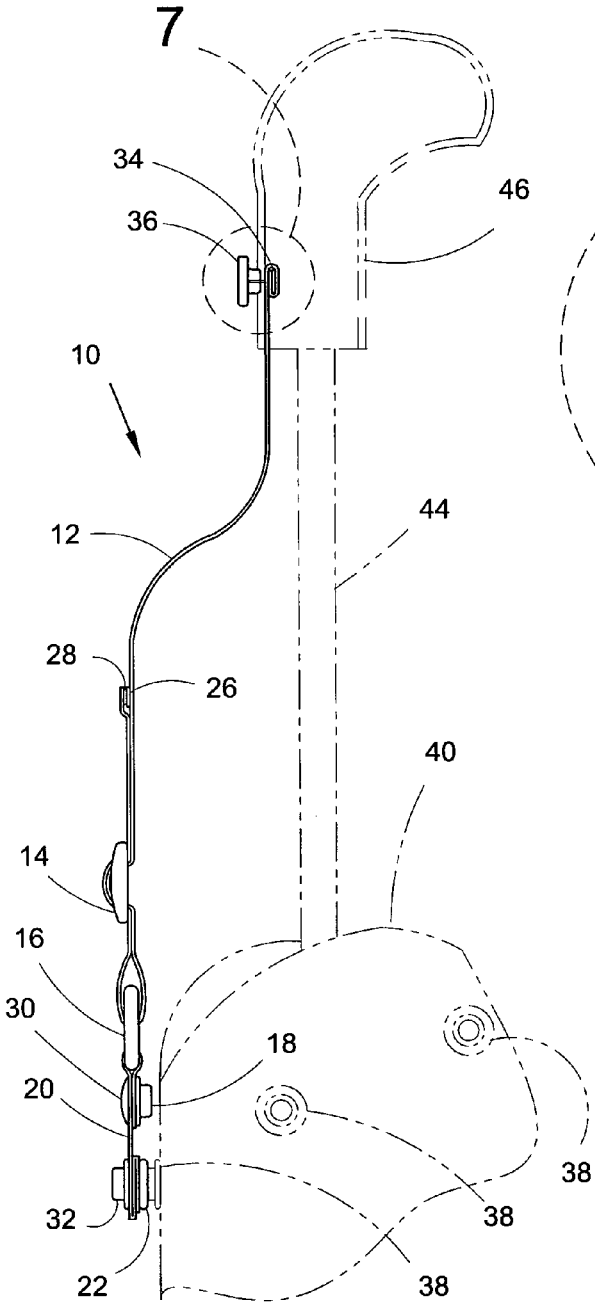
FIG. 6 is a partial side view showing a head cover tether connected between a standard golf bag cover attachment stud on a standard golf bag and a head cover on a club in a golf bag.
Figure 7:
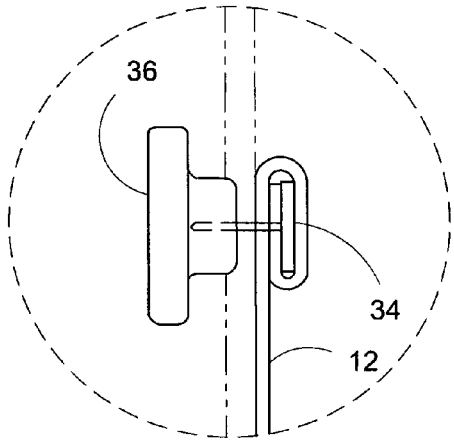
FIG. 7 is an enlarged view of distal end of head cover tether.

FIG. 6 shows the embodiment from FIG. 3 where pin protector 24 is removed from button pin 34 as shown in FIG. 1B and the distal end of head cover tether 10 is extended inside head cover 46 and the point of button pin 34 is pushed through the side wall of head cover 46 and into locking button 36 in a semi-permanent mounting. FIG. 7 is an enlarged view of the distal end of tether 10.

Multi-head cover tethers 11 can be assembled in 2 or 3 cover sets on a single gypsy stud 32 and socket fastener 22 as shown in FIG. 9A and 9B respectively. Note that these embodiments with single socket fastener 22 can be snapped on to attachment stud 38 without stacking them on individual gypsy studs 32 as in FIG. 8. Multi-head Cover Tethers 11 allow all of bag cover attachment studs 38 to be used for attaching bag cover securely without removing multi-head cover tethers 11. The enlarged section view of 9C shows the assembly of gypsy stud 32, three short straps 20, staked into socket fastener 22.

The embodiments shown and described herein are exemplary in nature and alteration in sizes and types of materials are not so limited.

What is claimed:

1. A golf club head cover and glove tether kit comprised of:

a plurality of head cover straps with length adjustable means, proximal ends, distal ends, inside surfaces, and outside surfaces where said proximal ends of said head cover straps have an attachment means that connect said proximal ends of said head cover straps to a golf bag and where said distal ends of said head cover straps have an attachment means that connect said distal ends to said golf club head covers; and a glove strap with a proximal end, a distal end, an inside surface and an outside surface where said proximal ends of said glove strap has an attachment means that connects said proximal end of said glove strap to said golf bag and where said distal end of said glove strap has an attachment means that connects to a hook and loop type closure on said golf glove where said attachment means for connecting said proximal ends of said head cover straps and said proximal end of said glove strap to said golf bag is chosen from:

a gypsy stud on said outside surface of said head cover and glove strap's proximal end staked through said strap into a socket fastener that snaps on a golf bag cover attachment stud; or a gypsy stud on said outside surface of said head cover strap's and glove strap's proximal end staked through said strap into said socket fastener, and a stud fastener also on said inside surface of said head cover straps and glove strap a sufficient distance from said socket fastener such that when said proximal ends of said head cover straps and glove strap are looped around a handle, a ring or a closed end projection on said golf bag said socket fastener snaps on to said stud fastener; or a gypsy stud on said outside surface of said head cover and glove strap's proximal end staked through said strap into said socket fastener on said inside surface where multiple straps can be stacked, placing one socket fastener on a bag mounting stud and subsequent head cover and glove socket fasteners on said gypsy studs; or a gypsy stud staked through two or three proximal ends of head cover straps into a socket fastener on said inside surface of said head cover straps where said socket fastener is snapped on a golf bag cover mounting stud on the top side of said golf bag.

2. The tether kit of claim 1 where said attachment means between said head cover strap and said golf club head cover is comprised of:

a locking pin with a head, a shaft, and a point; and a locking button, where said locking pin is inserted through said inside surface of said distal end of said head cover strap, said head cover strap is wrapped over said head of said locking pin, pushed through second layer of said head cover strap, and pushed through said head cover from the inside into said locking button and where said attachment means between said glove strap and said golf glove is comprised of:

a pad of hook and loop type material connected to said distal end of said glove strap of sufficient size to mate with a hook material pad on the inside of the back of a golf glove closure and a loop material pad on the outside of the back of a said golf glove closure.

* * * * *